US008176583B2

(12) United States Patent
Jacobs et al.

(10) Patent No.: US 8,176,583 B2
(45) Date of Patent: May 15, 2012

(54) SIDERAIL ASSEMBLY

(75) Inventors: Neal Kenneth Jacobs, Carmel, IN (US); Brian T Wiggins, Burlington, KY (US)

(73) Assignee: Hill-Rom Services, Inc., Batesville, IN (US)

( * ) Notice: Subject to any disclaimer, the term of this patent is extended or adjusted under 35 U.S.C. 154(b) by 10 days.

(21) Appl. No.: 12/724,000

(22) Filed: Mar. 15, 2010

(65) Prior Publication Data

US 2011/0219541 A1 Sep. 15, 2011

(51) Int. Cl.
*A47C 21/08* (2006.01)

(52) U.S. Cl. ..... 5/430; 5/424; 5/425

(58) Field of Classification Search ..... 5/424–430
See application file for complete search history.

(56) References Cited

U.S. PATENT DOCUMENTS 5,129,117 A * 7/1992 Celestina et al. ..... 5/602
2009/0229051 A1 9/2009 Heimbrock

* cited by examiner

*Primary Examiner* — Fredrick Conley
(74) *Attorney, Agent, or Firm* — Barnes & Thornburg LLP

(57) ABSTRACT

A siderail assembly 40 for a bed 20 includes a link P pivotably connectable to a bed frame at a joint PF and to a rail at a joint PR. The link P has at least one reaction surface 64, 66. The assembly also includes a link R having a rail end 78 and a common end 80. The rail end of link R is pivotably connected to the rail at a joint RR. The assembly also includes a link Q having a frame end 72 and a common end 74. The frame end of link Q is pivotably connected to the frame at a joint QF. The common ends of link Q and link R are pivotably connected to each other at a joint A constrained to move substantially parallel to the reaction surface.

19 Claims, 17 Drawing Sheets

SIDERAIL ASSEMBLY

TECHNICAL FIELD

The subject matter described herein relates to a siderail assembly for a bed of the type typically used in hospitals or other institutional or home care settings.

BACKGROUND

Hospital beds include a base frame, an elevatable frame including a deck, and a mattress supported by the deck. A typical bed also includes four siderail assemblies: left and right side assemblies near the head end of the bed, and left and right side assemblies near the foot end of the bed. Each siderail assembly includes a rail portion connected to the elevatable frame by links so that the rail, the elevatable frame and the links constitute a mechanism. One commonly used arrangement is a four bar linkage "drop down" mechanism in which the rail (one bar) is connected to the elevatable frame (the second bar) by two links (the third and fourth bars) so that the rail is vertically adjustable relative to the deck between a raised or deployed position and a lowered or stowed position. When the rail is in the deployed or stowed positions it assumes a substantially upright orientation in close lateral proximity to the sides of the mattress. At intermediate positions the rail remains substantially upright but is laterally displaced from the mattress by a rail offset distance. The offset distance depends on the mechanical arrangement of the mechanism links and joints and varies as a function of rail vertical position.

When the rail is in its raised position the top of the rail must project vertically higher than the top of the mattress by a minimum amount, e.g. 9 inches (approximately 22.9 cm). In addition, the bottom of the rail must be no more than a specified distance, e.g. 2 inches (approximately 5.1 cm) higher than the top of the deck. These requirements govern the minimum vertical dimension of the rail.

When the rail is in its lowered or stowed position the top of the rail should be no higher than a slight distance above the height of the lateral extremities of the deck in order to facilitate occupant ingress and egress. In addition, the bottom of the rail must be at least a minimum distance above the floor when the elevatable frame, and therefore the deck, is positioned at its lowest elevation. This minimum distance provides clearance for a caregiver to position the wheels of a rolling table under the bed. The clearance also guards against accidental entrapment of an obstruction located under the rail when the rail is in the stowed position and the elevatable frame is being lowered toward the floor. Providing this floor clearance is especially desirable if the rail is designed so that the rail is unable to move vertically upwardly relative to the elevatable frame upon contact with an obstruction. If the rail is able to move vertically upwardly relative to the frame upon contact with an obstruction, a smaller floor clearance may be acceptable, particularly if the rail offset distance is small.

It is desirable to be able to position the elevatable frame so that the deck is as close to the floor as possible. However the above described constraints on the rail vertical dimension and floor clearance act together to limit the minimum height to which the frame and deck can be lowered. Accordingly, designers seek ways to achieve the lowest possible minimum deck height while adhering to the constraints. As noted above, reducing the rail offset distance offers a possible way to trade floor clearance in return for otherwise unattainable reductions in minimum deck height.

Another desirable attribute of a siderail assembly relates to the orientation of the rail portion of the assembly. A conventional "drop down" siderail assembly remains in a substantially upright orientation irrespective of its elevation (deployed, stowed or somewhere in between). When an occupant wishes to leave the bed a caregiver lowers at least one of the rails and the occupant sits near the edge of the bed with the lowered rail behind her calves and with her feet on the floor. The presence of the rail causes the occupant's feet to be further away from the bed, and therefore further away from her seated center of gravity, than would be the case if the rail were absent. If, however, the rail were in an inclined, bottom-in/top-out orientation (i.e. with the bottom closer to the mattress) the occupant could position her feet closer to her seated center of gravity, thereby achieving better stability when transitioning from being seated on the mattress to standing on the floor or vice versa.

Some bed decks have a "step" architecture featuring a horizontal platform, a wall rising from the lateral extremities of the platform and a horizontal ledge extending laterally outwardly from the upper end of each wall. The ledges and walls account for about 20% of the lateral dimension of the deck (measured horizontally); the platform accounts for about 80%. The corresponding mattress includes a vertically thick center section and a pair of vertically thinner, laterally extending wings. The mattress center section rests atop the deck platform; the wings rest atop the ledges. One advantage of the step architecture is that the space outboard of the deck walls and beneath the ledges (i.e. outboard of the mattress center section and beneath the mattress wings) is available for occupancy by other bed components, such as the links that connect the rail to the frame. The availability of this space offers the mechanism designer flexibility and options in link and joint positioning and trajectory, thereby making it easier to design a linkage capable of satisfying potentially conflicting requirements.

The previously noted design requirements for the rail, including the need to provide ground clearance, can make it difficult to design a siderail assembly capable of positioning the rail in compliance with the positioning requirements and capable of accurately reproducing a desired rail trajectory. As noted, some relief from the floor clearance requirements may be obtained by reducing the rail offset distance, but this merely adds an additional, potentially complicating requirement to the rail trajectory. The design task is further complicated if it desired to achieve the above described bottom-in/top-out orientation of the rail in its stowed position and/or if the siderail assembly must be designed for use with a flat deck rather than for use with the step deck and its attendant advantages for positioning the links and joints. It is, therefore, desirable to devise a simple, cost effective mechanism capable of meeting the various requirements, including the bottom-in/top-out stowed orientation if desired, even if confined by the need to apply the siderail assembly to a bed having a flat deck.

SUMMARY

A siderail assembly for a bed includes a link P pivotably connectable to a bed frame at a joint PF and to a rail at a joint PR. The link P has at least one reaction surface. The assembly also includes a link R having a rail end and a common end. The rail end of link R is pivotably connected to the rail at a joint RR. The assembly also includes a link Q having a frame end and a common end. The frame end of link Q is pivotably connected to the frame at a joint QF. The common ends of link Q and link R are pivotably connected to each other at a joint A constrained to move substantially parallel to the reaction surface.

BRIEF DESCRIPTION OF THE DRAWINGS

The foregoing and other features of the various embodiments of the siderail assembly described herein will become more apparent from the following detailed description and the accompanying drawings in which.

DETAILED DESCRIPTION

Figure 1:
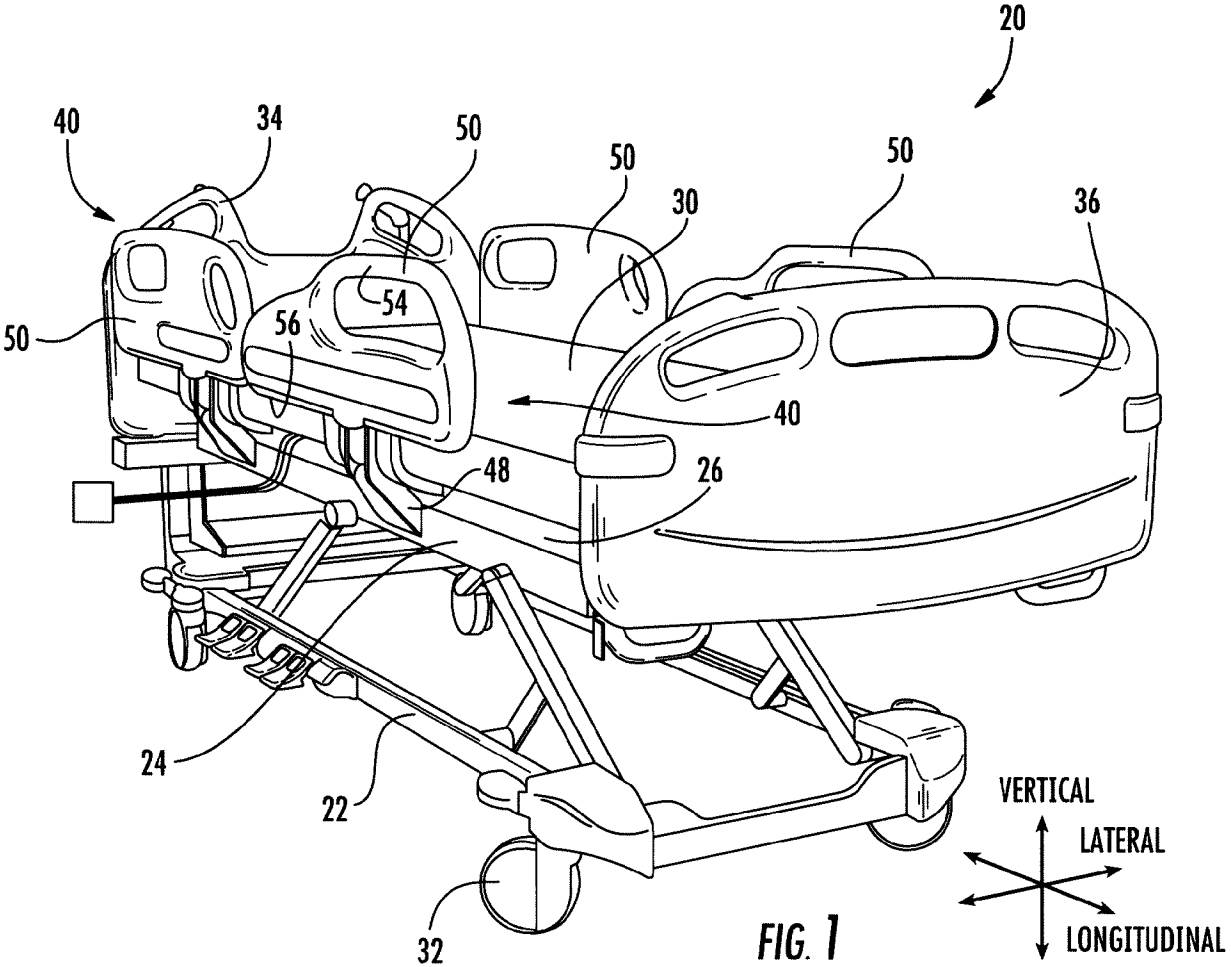
FIG. 1 is a perspective view of a hospital bed having four siderial assemblies.

FIG. 1 shows a typical hospital bed 20 including a base frame 22, and an elevatable frame 24 supported on the base frame. The elevatable frame includes a deck 26 which may be longitudinally segmented into two or more sections, at least some of which can be non-horizontally oriented. The bed also includes a mattress 30 supported by the deck. Casters 32 provide the bed with mobility. A headboard 34 and a footboard 36 are mounted on the elevating frame. The bed also includes four siderail assemblies 40, one each at the left and right sides toward the head end and at the left and right sides near the foot end. Each siderail assembly includes a rail portion 50 having a top 54 and a bottom 56. Links 48 connect each rail to the elevatable frame so that the rail, elevatable frame and links constitute a mechanism. Such an arrangement renders the rails vertically adjustable relative to the deck between a raised or deployed position and a lowered or stowed position. The illustration also include reference axes signifying longitudinal, lateral and vertical directions.

Figure 2:
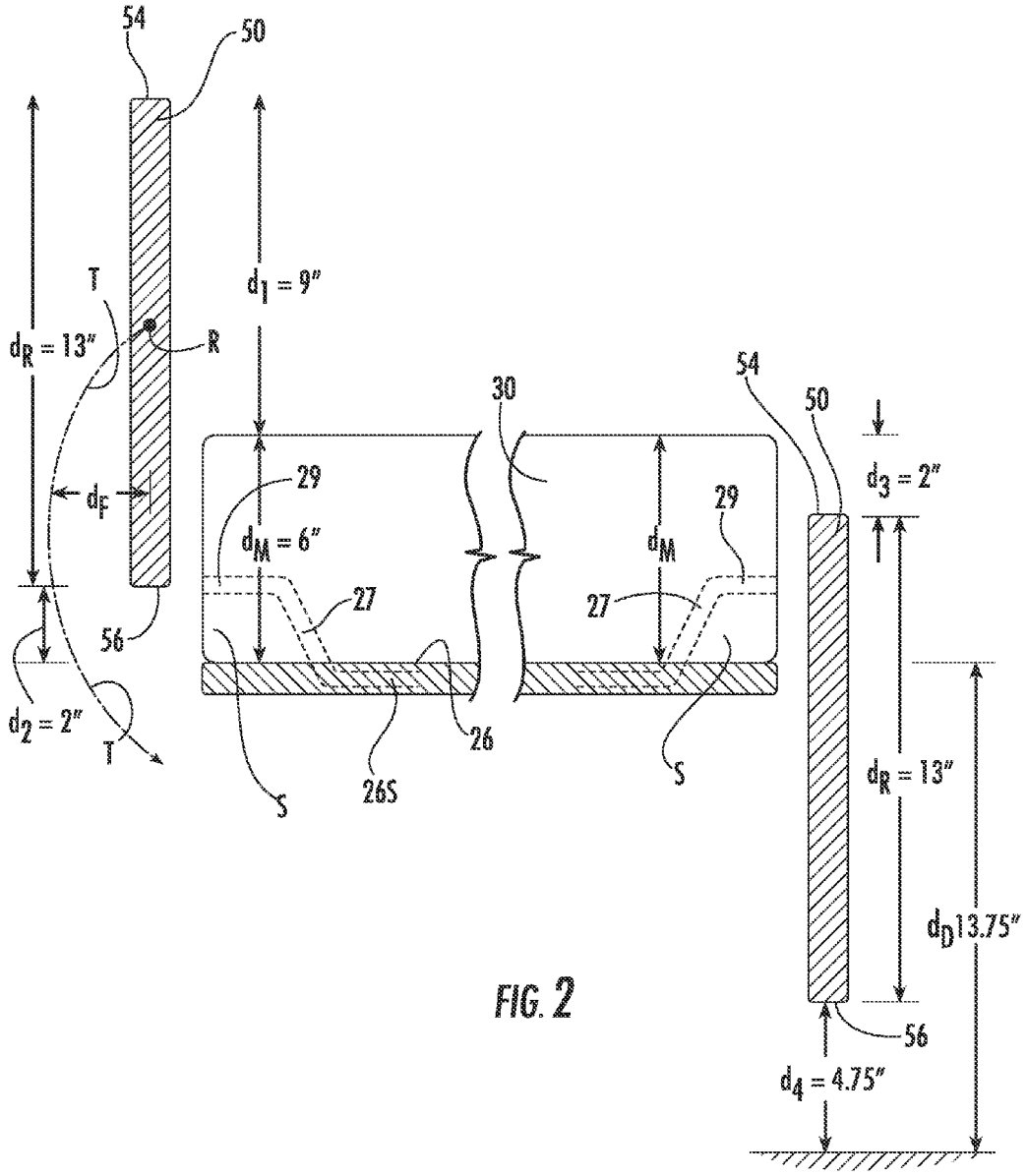
FIG. 2 is a schematic, end elevation view illustrating relevant dimensions and relationships of concern to a designer of the siderail assemblies.
Figure 3:
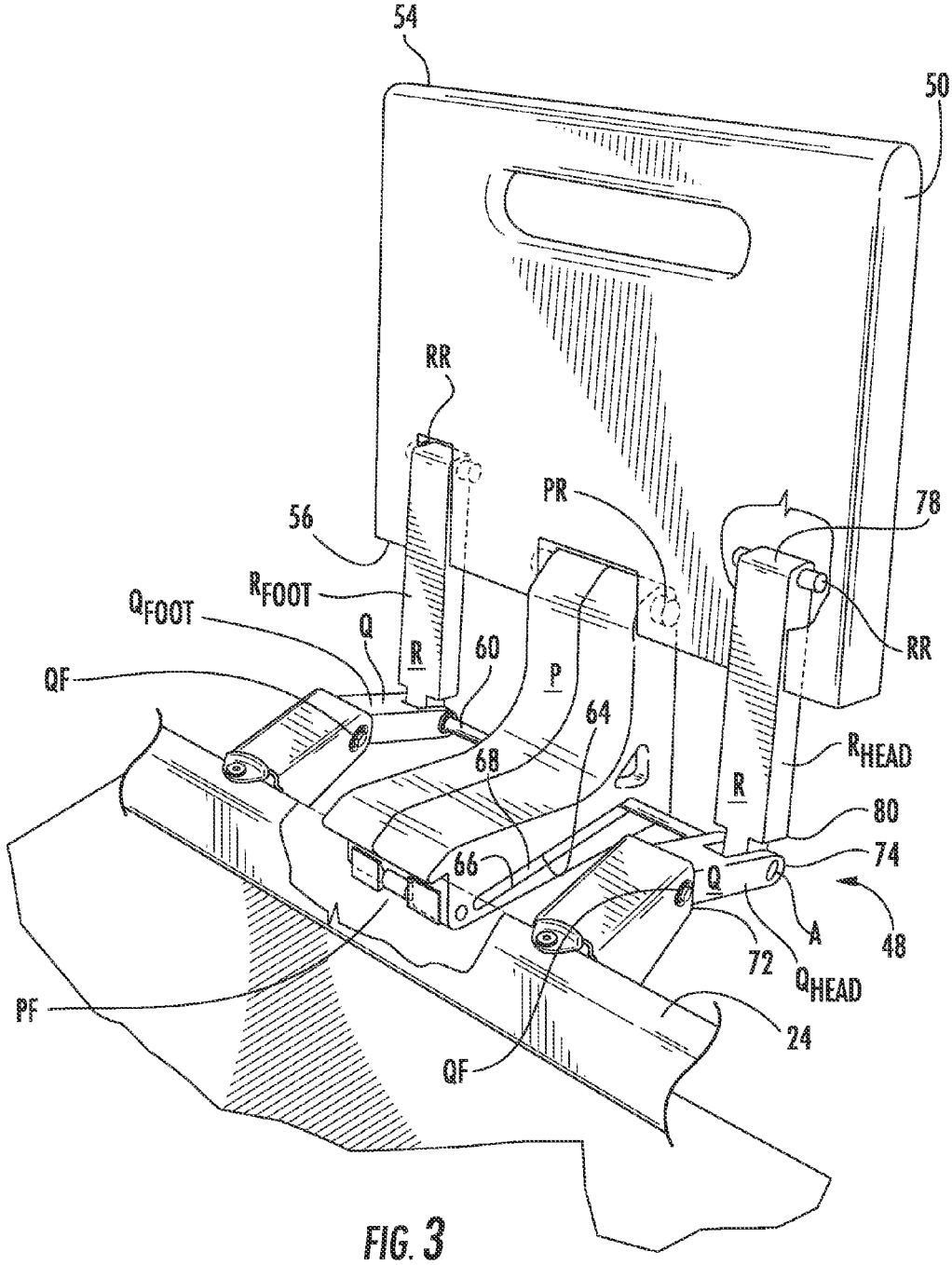
FIGS. 3-6 are a sequence of perspective views showing one embodiment of a siderail assembly described herein in a deployed position (FIGS. 3-4) a first intermediate position (FIG. 5) and a second intermediate position (FIG. 6).
Figure 4:
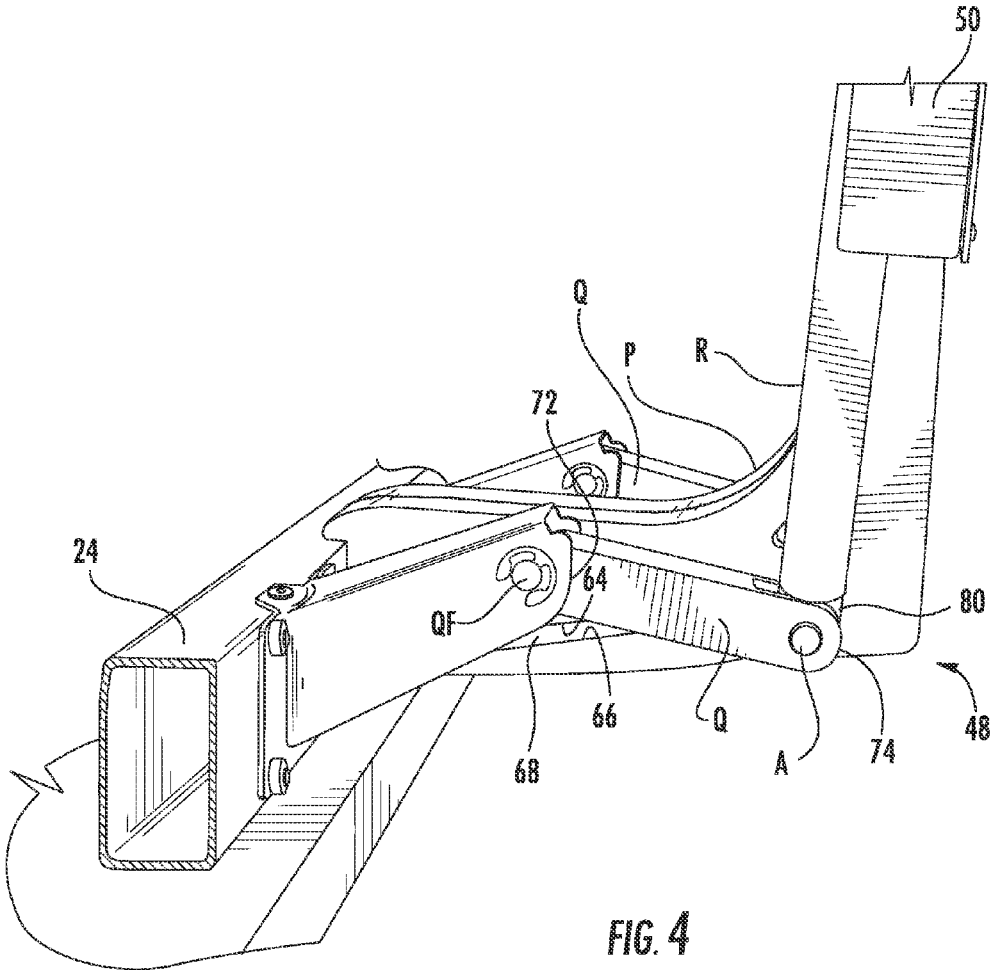
Figure 5:
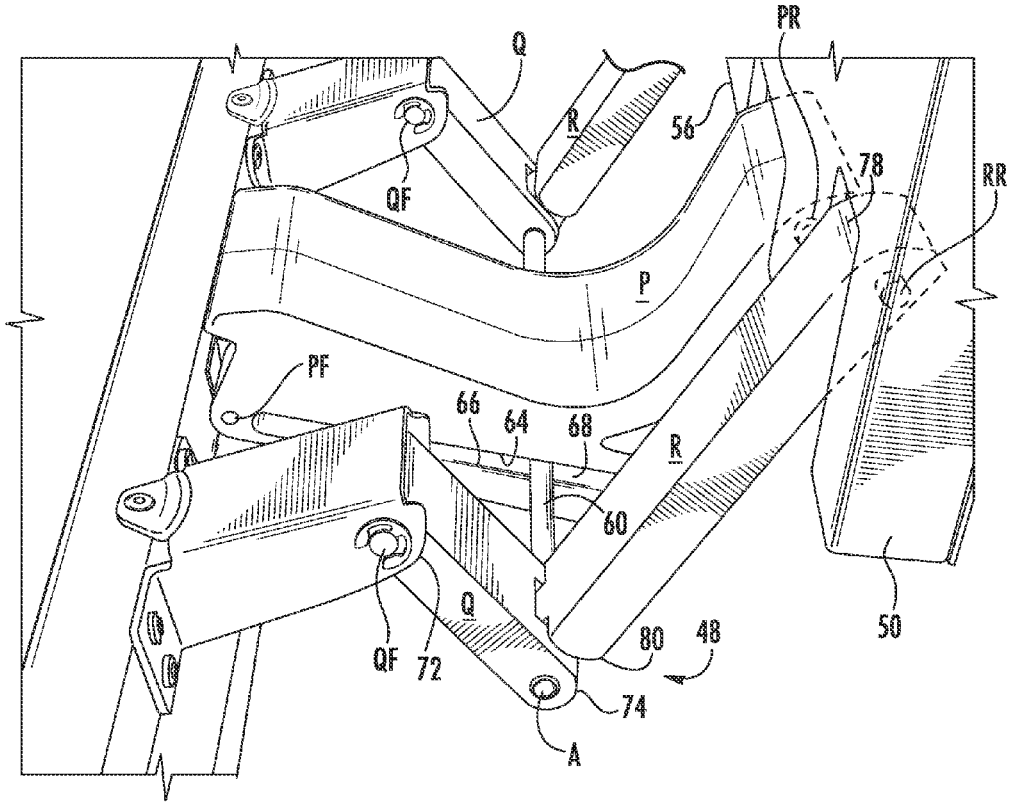
Figure 6:
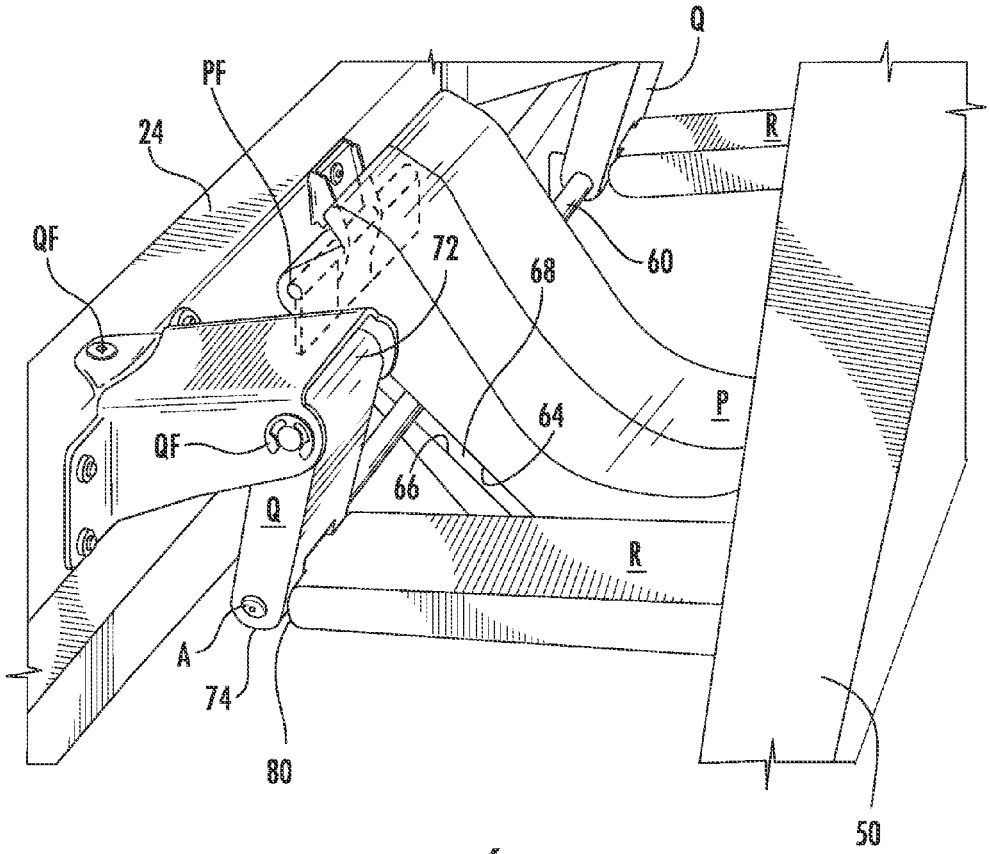
Figure 7:
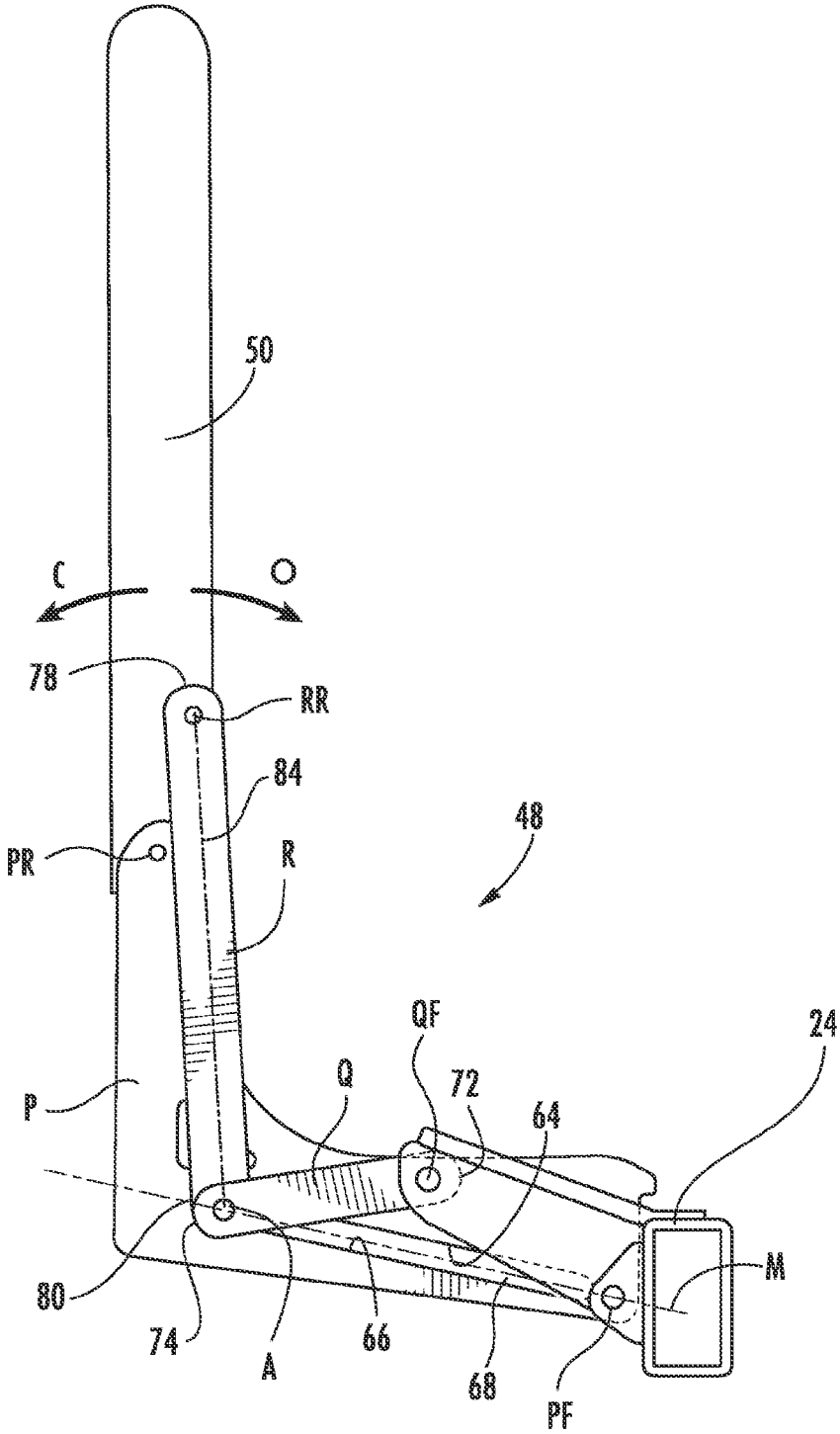
FIGS. 7-10 are a sequence of schematic end elevation views showing the embodiment of the siderail assembly in a deployed position (FIG. 7) a first intermediate position (FIG. 8) a second intermediate position (FIG. 9) and a stowed position (FIG. 10).
Figure 8:
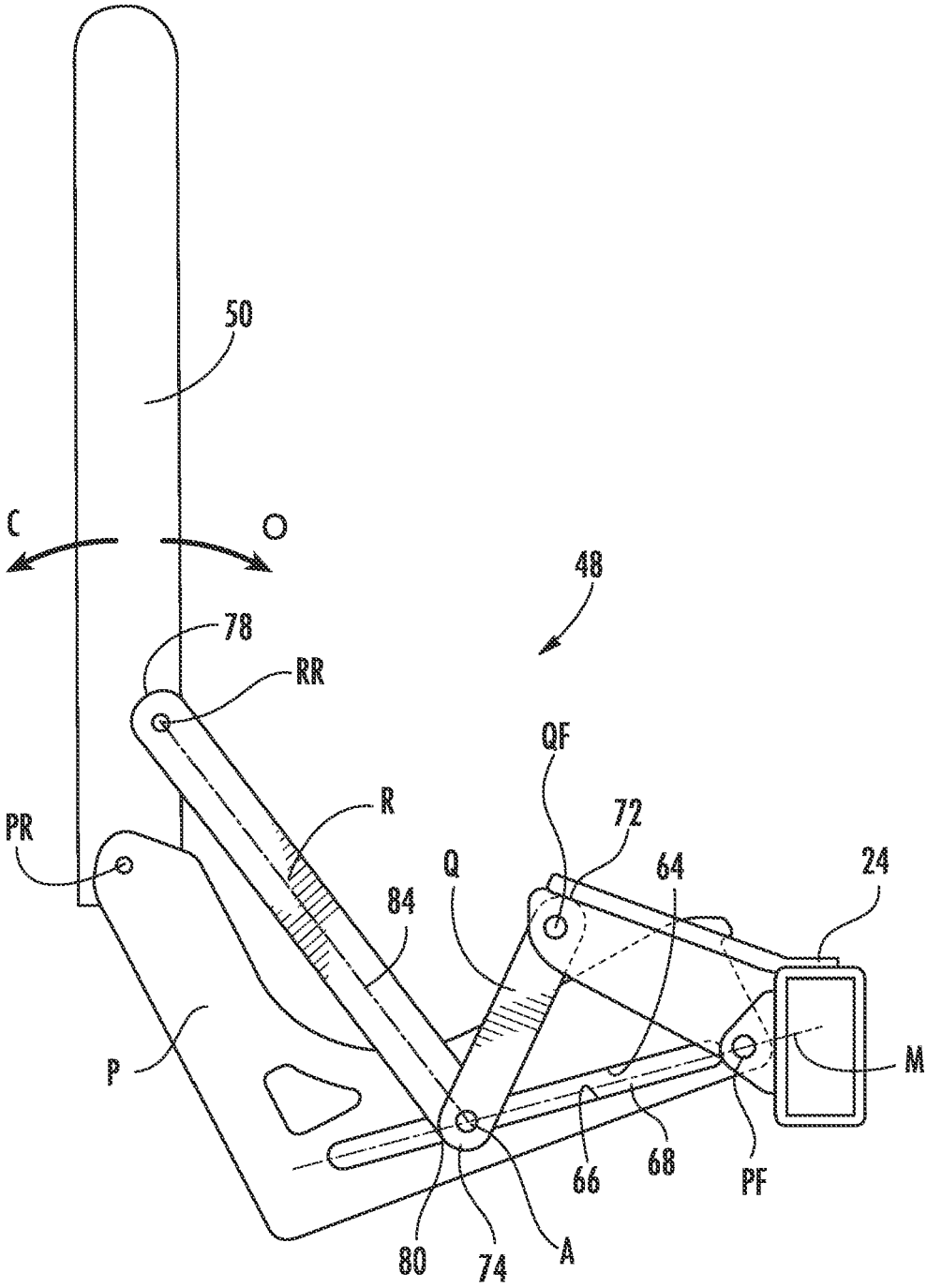
Figure 9:
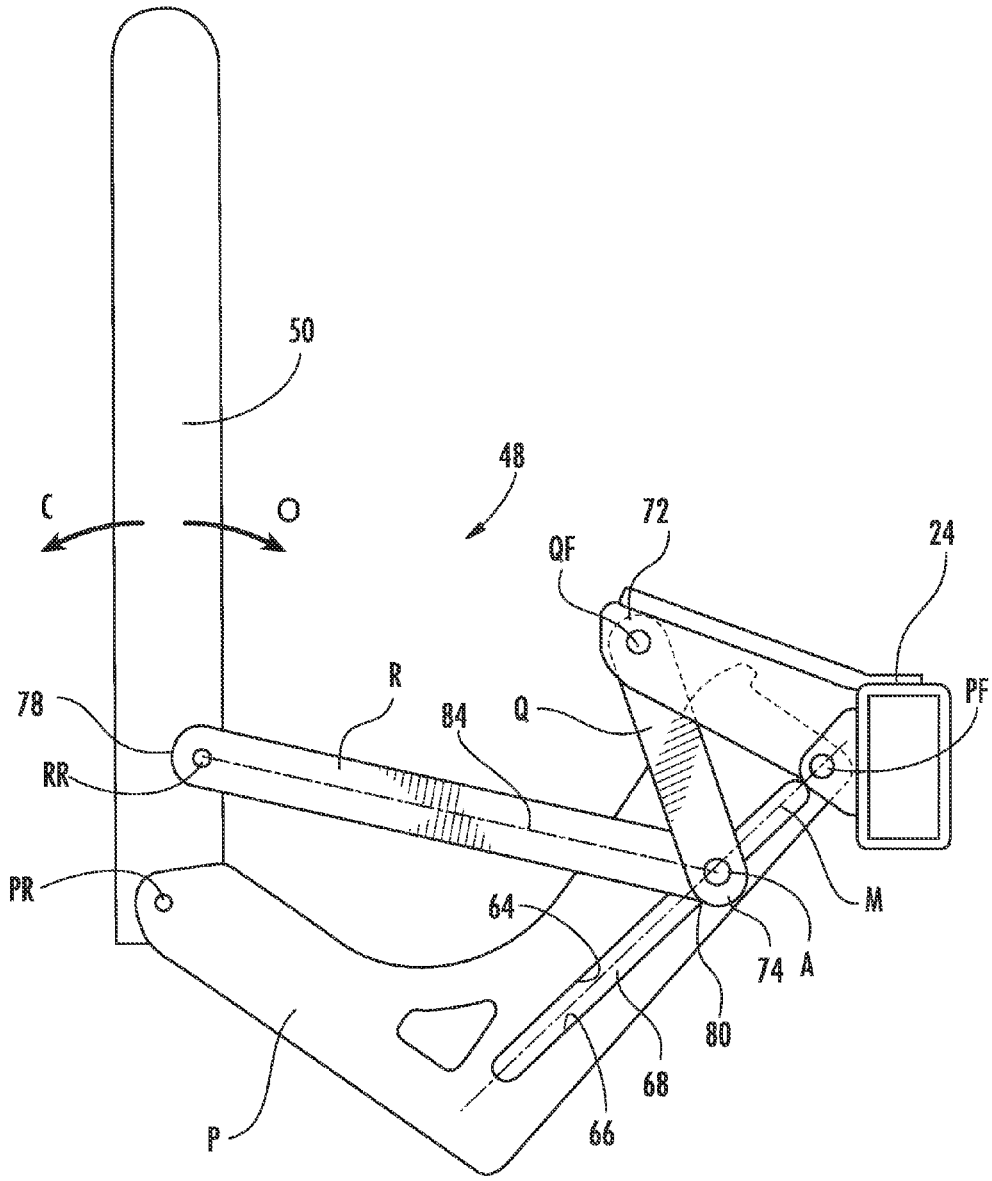

FIG. 2 is a schematic, end elevation view of a flat deck 26, mattress 30 and rail portions 50 of left and right siderail assemblies illustrating various requirements described in the Background section of this application. The laterally outer extremities of a step deck 26S, including the deck walls 27 and ledge 29, are also shown, in phantom, for comparison. The rail portion 50 on the left side of the illustration is in its raised or deployed position. The rail portion on the right side of the illustration is in its lowered or stowed position. The mattress has a thickness $d_M$, for example 6 inches (approximately 15.2 cm). When deployed, the top 54 of the rail must be a distance $d_1$, for example 9 inches or about 22.9 cm, above the top of the mattress. The distance $d_2$ between the deck and the bottom 62 of the rail must be no more than 2 inches (approximately 5.1 cm). These requirements establish the minimum rail height $d_R$ as: $d_1+d_M-2$, or about 13 inches (approximately 33 cm). In the stowed position, the top of the rail should be no higher than a slight distance above the deck 26 (or above the ledge 29 of a step deck). The illustration shows a rail which, when stowed, is a distance $d_3$ of about 2 inches (5.1 cm) below the top of the mattress. When the rail is stowed and the deck is at its lowest elevation the clearance between the floor and the bottom of the rail must not be less than $d_4$. Taking $d_4$ as about 4.75 inches (approximately 12.1 cm), the lowest elevation $d_D$ of the deck, compliant with the requirements, is $d_D=d_4+d_R+d_3-d_M$, or about 13.75 inches. As already noted, complying with the requirements is difficult, particularly if the deck is a flat deck 26 which, unlike step deck 26S, does not offer the space S beneath deck ledge 29 of the mattress in which the designer can locate at least part of the siderail mechanism. The illustration also shows a sample trajectory T which an arbitrarily chosen point R follows during raising or lowering of the rail. The lateral displacement $d_F$ is the aforementioned offset distance. As noted, a mechanism that limits the offset distance might allow some relaxation of the floor clearance requirement $d_4$ from 4.75 inches to about 3 inches.

FIGS. 3-10 show the siderail mechanism in more detail. The mechanism includes a link P pivotably connected to frame 24 at a joint PF and to rail 50 at a joint PR. Link P includes at least an upper reaction surface 64 or a lower reaction surface 66. The illustrated link P includes both reaction surfaces. As seen best in FIGS. 7-10 the surfaces are substantially parallel to each other and define a slot 68 having a meanline M.

The mechanism also includes a link Q having a frame end 72 and a common end 74 and a link R having a rail end 78 and a common end 80. In the illustrated embodiment links Q and R are each divided into a head end portion $Q_{HEAD}$, $R_{HEAD}$ and a foot end portion $Q_{FOOT}$, $R_{FOOT}$ longitudinally spaced apart from the head end portion. Link P is longitudinally between the head end portions $Q_{HEAD}$, $R_{HEAD}$ and the foot end portions $Q_{FOOT}$, $R_{FOOT}$. The frame end 72 of link Q is pivotably connected to the frame at a joint QF. The rail end 78 of link R is pivotably connected to the rail at a joint RR. The common ends 74, 80 of the links Q and R are pivotably connected to each other at a joint A which includes rod 60. Joint A is constrained to move along a trajectory substantially parallel to whichever of the reaction surfaces 64 or 66 is present. In the illustrated embodiment rod 60 of joint A fits snugly in the slot 68. As a result, joint A is constrained to move along the slot, i.e. in a direction substantially parallel to the two reaction surfaces 64, 66.

Figure 10:
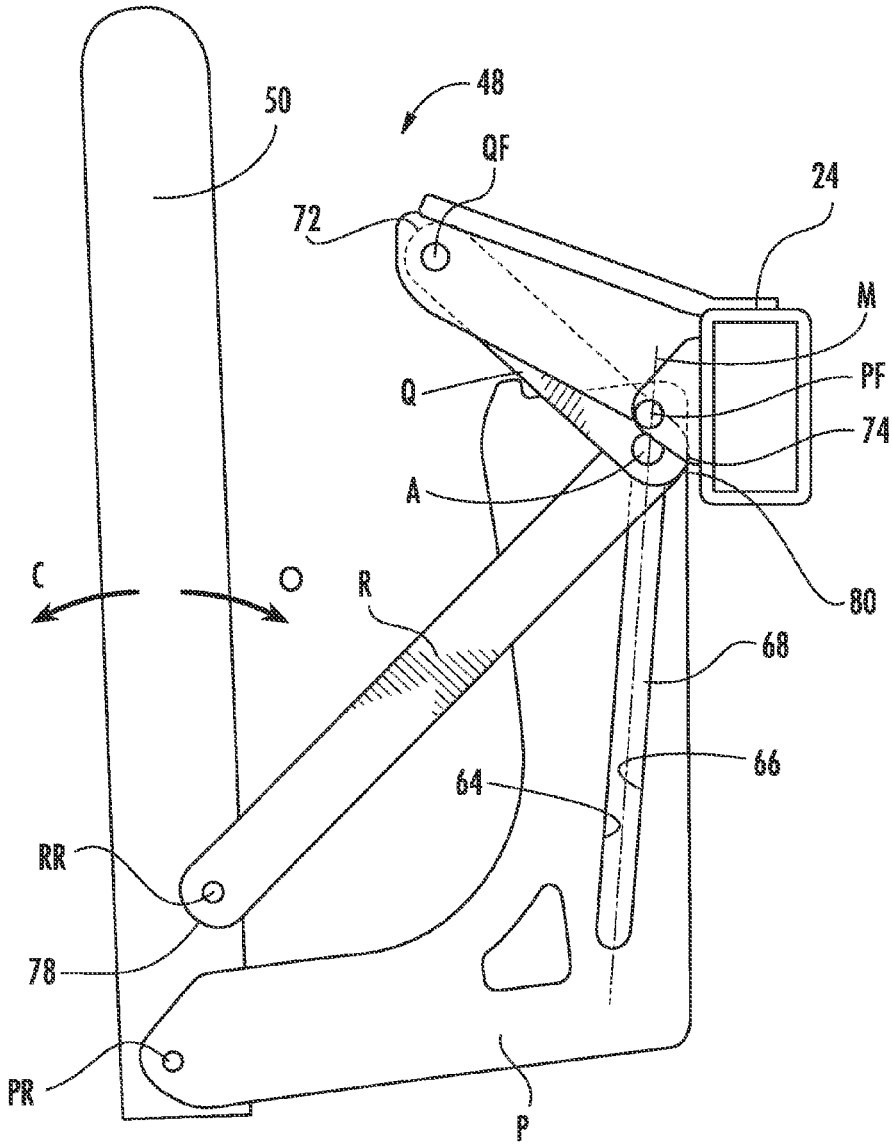

FIGS. 3-6 show the moveability of the rail relative to the frame. The rail is moveable through a range of motion that includes its deployed position (FIGS. 3-4) a first intermediate position (FIG. 5), a second intermediate position (FIG. 6) and its stowed position (not shown in the sequence of views of FIGS. 3-6). FIGS. 7-10 also show the movability of the rail through a range of positions including its deployed position (FIG. 7) a first intermediate position (FIG. 8) a second intermediate position (FIG. 9) and its stowed position (FIG. 10). The intermediate positions of FIGS. 5 and 6 do not necessarily correspond to the intermediate positions of FIGS. 8 and 9. The rail is latchable only at its deployed position so that the rail can be moved from the deployed position only after the latch has been released. At all other positions the rail is always in an unlatched state and can be moved without the need to first release a latch. The orientation of the reaction surfaces 64, 66 is such that lower reaction surface 66 resists any tendency of rail 50 to rock toward the occupant side of the bed and upper reaction surface 64 resists any tendency of rail 50 to rock toward the caregiver side of the bed as indicated by arrows O and C respectively in FIGS. 7-10. Because of the orientation of surfaces 64, 66, any tendency of rail 50 to rock in direction O will be reacted at lower surface 66, resulting in compressive loading on link R. Similarly, any tendency of the rail to rock in direction C will be reacted at upper surface 64, resulting in tensile loading on link R. Each reaction surface and a line 84 between joint RR and joint A are sufficiently nonparallel to each other throughout the range of motion to resist the tendency of the rail to rock in directions O or C. The sufficient nonparallelism constrains, but does not necessarily prohibit, relative movement of joints RR and PR. One specific nonparallel arrangement believed to be effective is one in which the reaction surfaces 64, 66 are more perpendicular than parallel to the line 84 between joints RR and A. Surfaces 64, 66 also help react loads that would otherwise have to be absorbed by the latch, thereby improving the durability of the latch.

Figure 11:
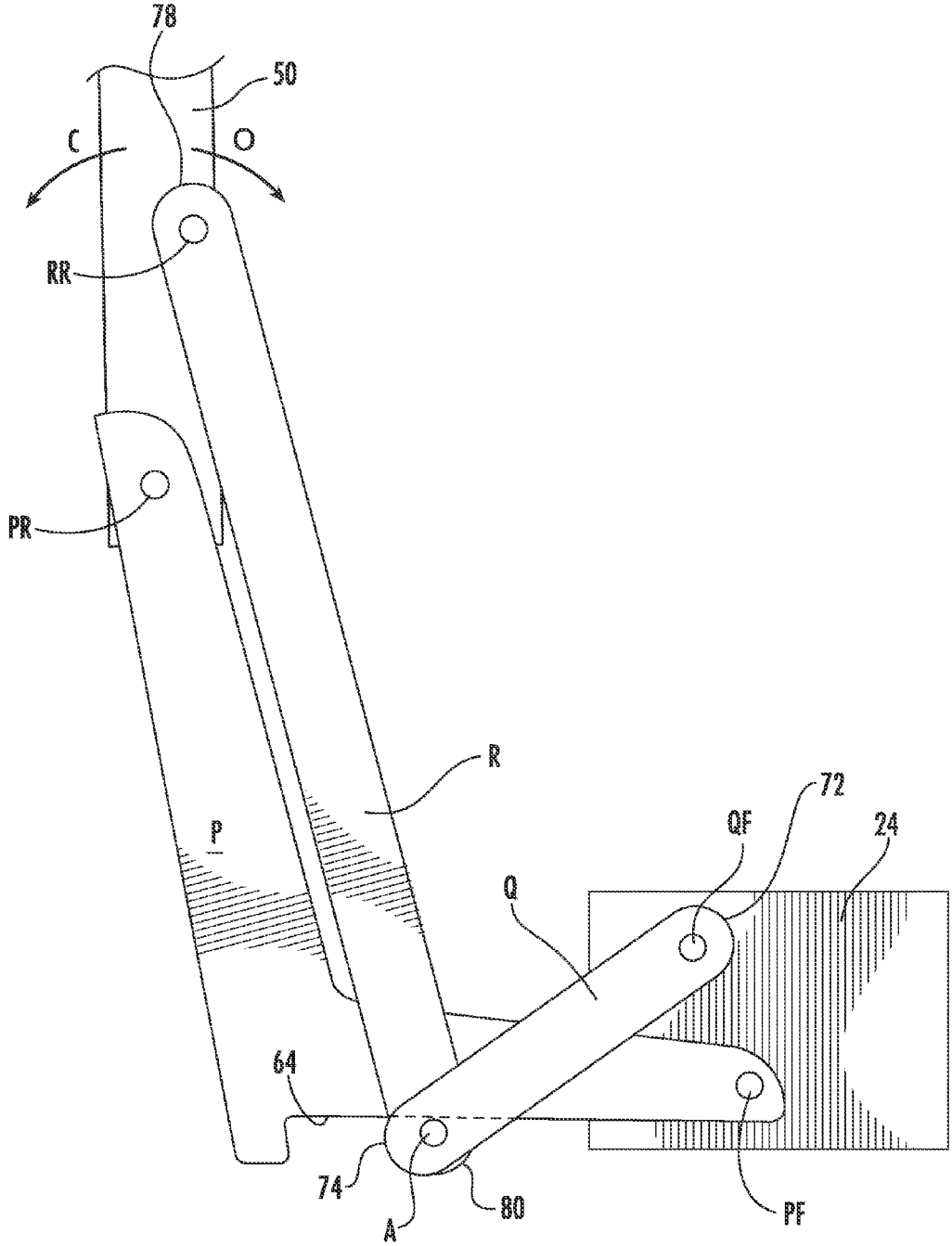
FIGS. 11-12 are end elevation views showing a variant of the siderail assembly in which a link P has only one of two reaction surfaces shown in the previous views.
Figure 12:
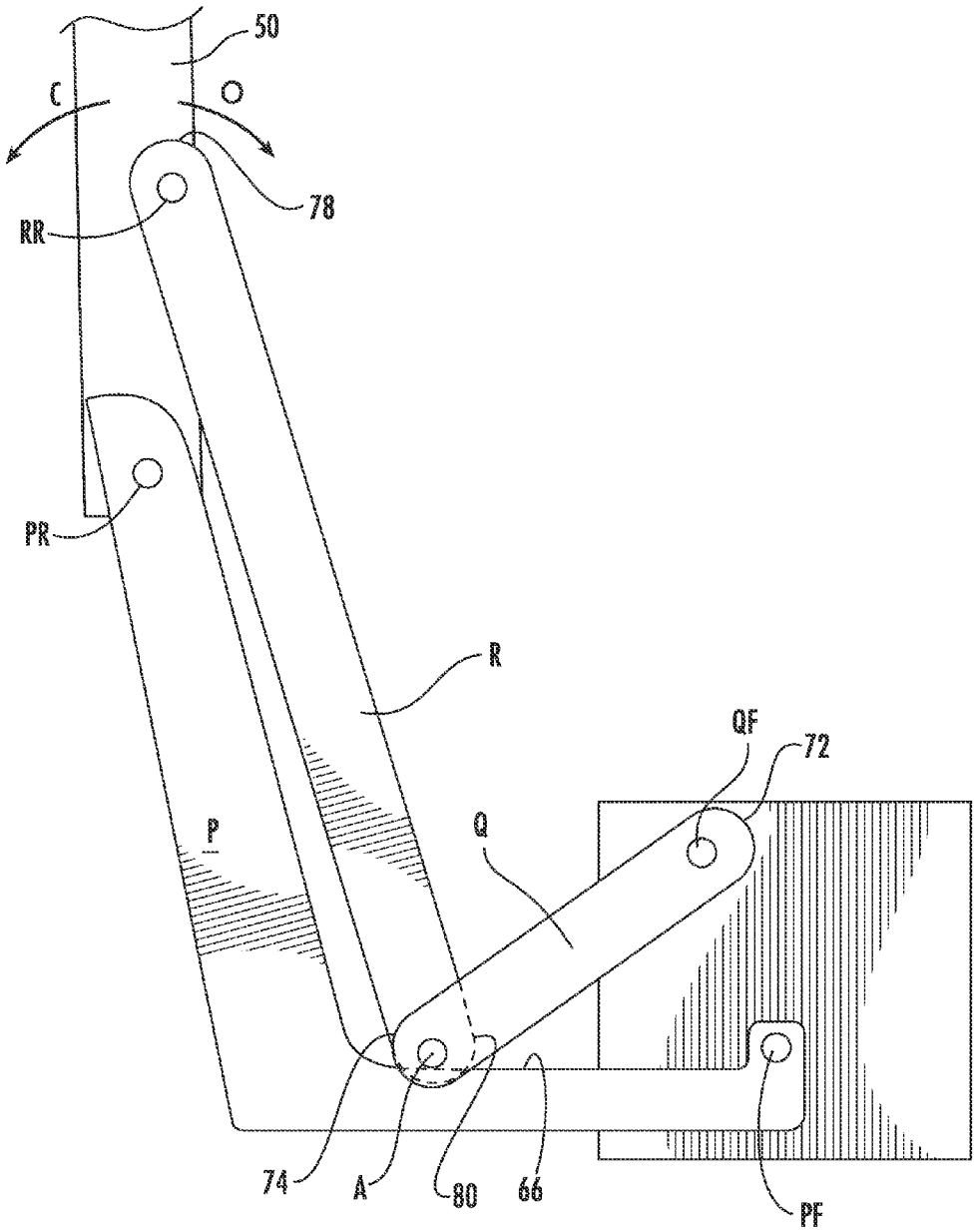
Figure 13:
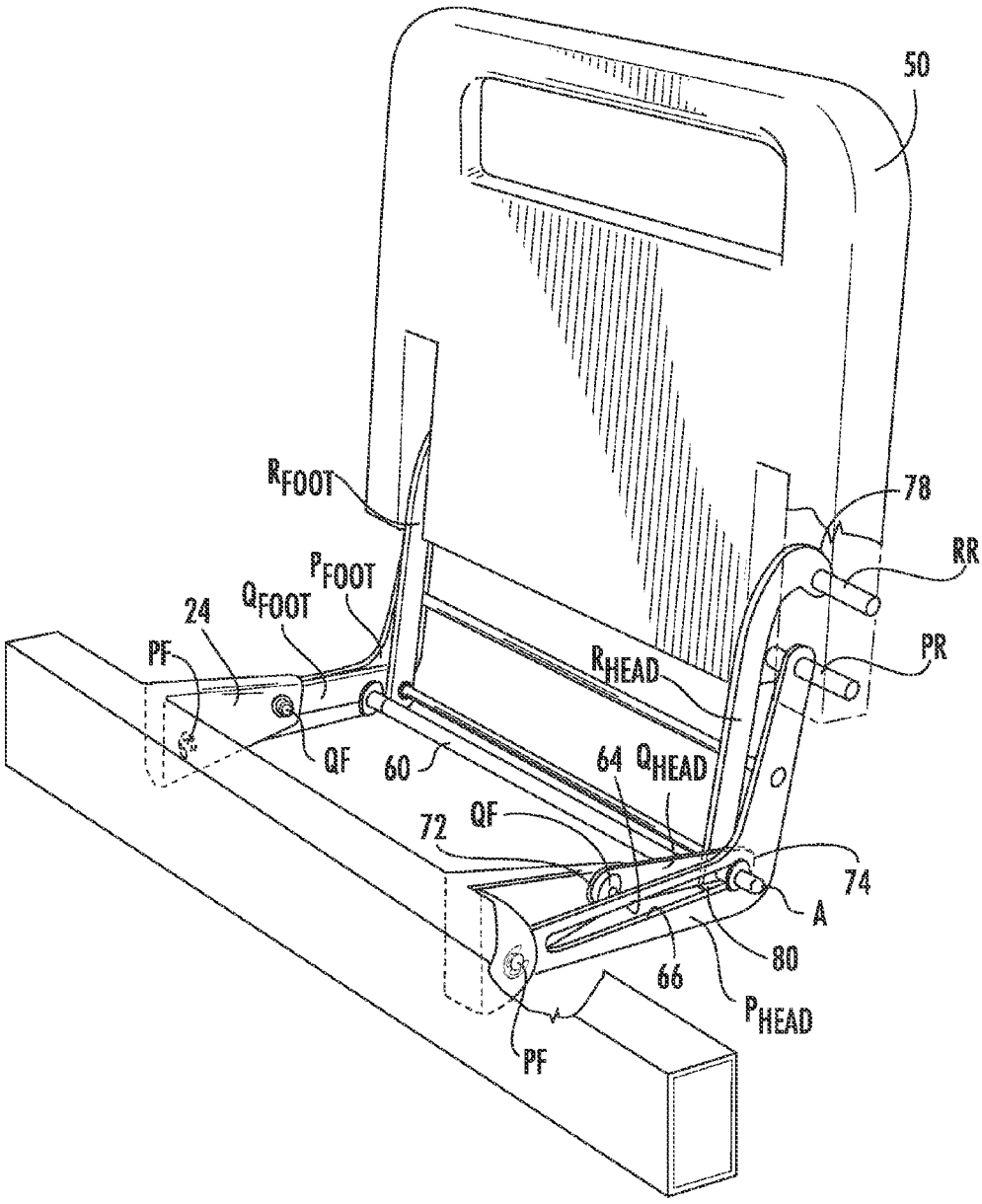
FIGS. 13-17 are a sequence of perspective views showing a second embodiment of a siderail assembly described herein in a deployed position (FIGS. 13-14) a first intermediate position (FIG. 15) a second intermediate position (FIG. 16) and a stowed position (FIG. 17).
Figure 14:
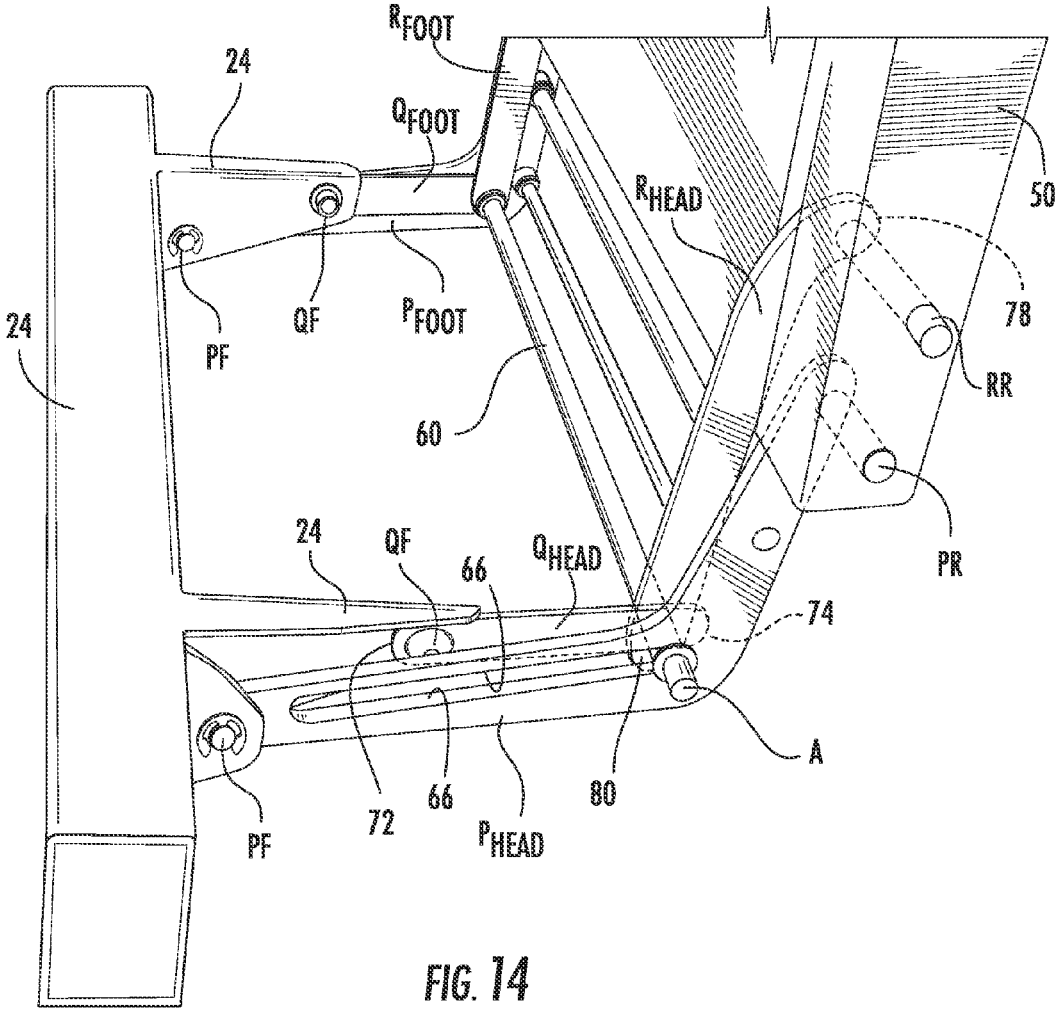
Figure 15:
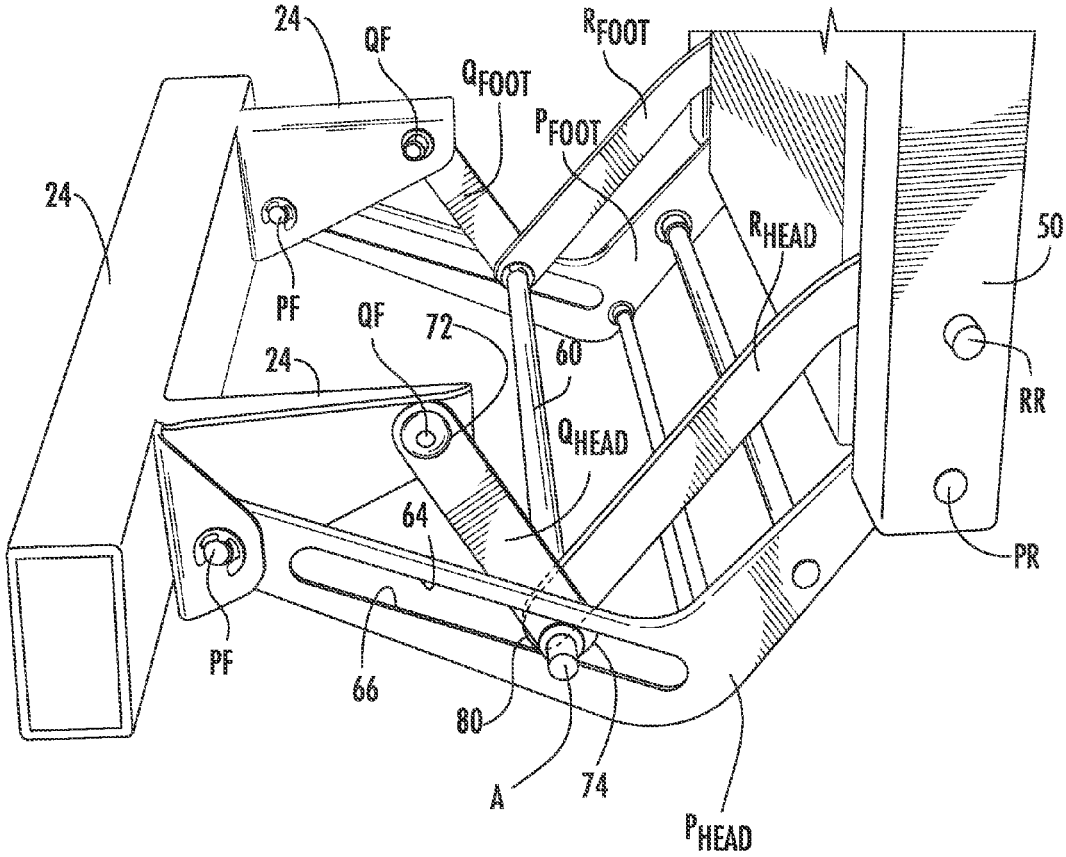
Figure 16:
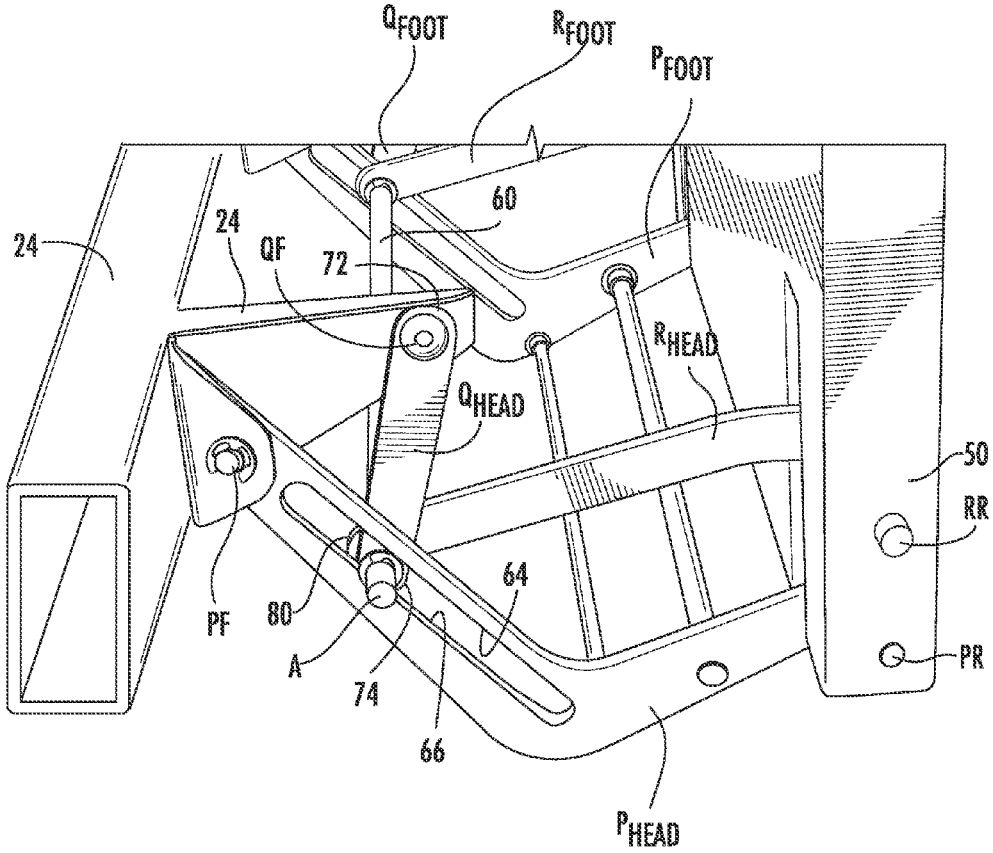

If the mechanism includes other constraints that resist motion of the rail in direction O, reaction surface 66 may be dispensed with as seen in FIG. 11. If the mechanism includes other constraints that resist motion of the rail in direction C, reaction surface 64 may be dispensed with as seen in FIG. 12.

In the illustrated embodiment the joints are spatially distributed, and the length of slot 68 is sized, such that the rail assumes a prescribed orientation at least in the deployed and stowed positions and so that the siderail assembly can be used with a flat deck.

Specifically the joints are spatially distributed and the slot is sized such that the deployed rail is in a substantially upright orientation (FIG. 7) the stowed rail is in a slightly laterally outwardly leaning orientation, i.e. a bottom-in/top-out orientation (FIG. 10) and at least joints PF and QF reside underneath a flat deck and laterally inboard of its lateral extremities.

Referring back to FIG. 2, the described siderail assembly complies with various requirements described in the Background section of this application. When deployed, the top 54 of the rail is a distance $d_1$, of at least 9 inches or about 22.9 cm, above the top of the mattress, which has a thickness $d_M$ of 6 inches (approximately 15.2 cm). The bottom 56 of the rail is a distance $d_2$ of no more than 2 inches (approximately 5.1 cm) higher than the top of the deck. The horizontal distance between the rail and joint PF is constrained to be no more than about 6 inches (about 15.2 cm). When the deck is at its minimum elevation, as measured from the floor to the lowest point on the top of the deck, and the rail is in its stowed position, the clearance between the floor and the bottom of the rail is at least 3 inches (approximately 7.6 cm). The 3 inch clearance, rather than a larger clearance, is satisfactory because the mechanism limits the offset distance or lateral displacement $d_F$ of the rail during raising or lowering and because the rail is not latchable, except in its deployed position.

Compliance with the requirements is achieved even though the deck is a flat deck rather than a step deck in which part of the mechanism can reside in the space S defined by the wall 27 and ledge 29 (FIG. 2) of the step deck 26S (or alternatively defined by the center section and wings of an associated step mattress). Joints PF and QF of the disclosed mechanism reside at an elevation lower than all portions of the deck and all portions of the mattress.

Figure 17:
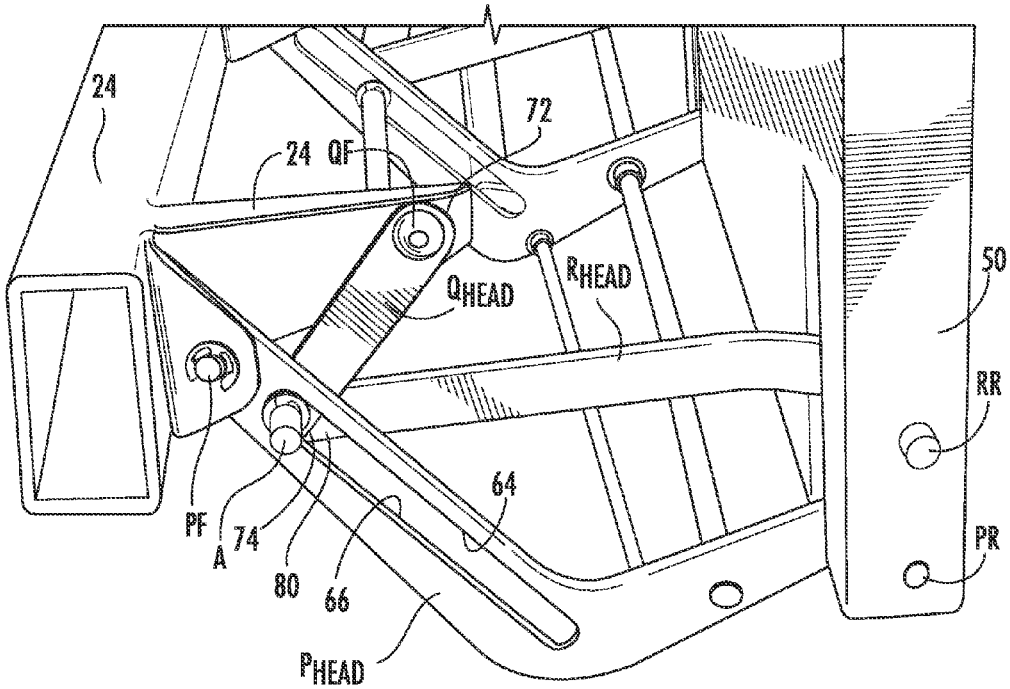

FIGS. 13-17 are a sequence of views illustrating an alternate embodiment in its deployed position (FIGS. 13-14), a first intermediate position (FIG. 15) a second intermediate position (FIG. 16) and its stowed position (FIG. 17). The first intermediate position of FIG. 15 does not necessarily correspond to that of FIGS. 5 and 8, nor does the second intermediate position of FIG. 16 necessarily correspond to that of FIGS. 6 and 9. In this alternate embodiment all three of links P, Q and R are each divided into a head end portion $P_{HEAD}$, $Q_{HEAD}$, $R_{HEAD}$ and a foot end portion $P_{FOOT}$, $Q_{FOOT}$, $R_{FOOT}$ longitudinally spaced apart from the corresponding head end portion. Links Q and R are longitudinally between the head end portion $P_{HEAD}$ and the foot end portion $P_{FOOT}$ of link P. The frame end 72 of link Q is pivotably connected to the frame at a joint QF. The rail end 78 of link R is pivotably connected to the rail at a joint RR. The common ends 78, 80 of the links Q and R are pivotably connected to each other at a joint A. Joint A is constrained to move along a trajectory substantially parallel to whichever of the reaction surfaces 64 or 66 is present. In the illustrated embodiment joint A fits snugly in the slot 68 and is therefore constrained to move along the slot, i.e. in a direction substantially parallel to the two reaction surfaces 64, 66. Although links Q and R are divided into head and foot end portions in the alternate embodiment, they could be unitized, similar to link P of the first embodiment. As with the first embodiment, if the mechanism includes other constraints that resist motion of the rail in direction O or C, reaction surface 66 or 64 may be dispensed with.

Although this disclosure refers to specific embodiments, it will be understood by those skilled in the art that various changes in form and detail may be made without departing from the subject matter set forth in the accompanying claims.

We claim:

1. A siderail assembly for a bed comprising:

a link (P) pivotably connectable to a bed frame at a joint (PF) and to a rail at a joint (PR), the link (P) being pivotable relative to rail about a first pivot axis, the link (P) having at least one reaction surface;

a link (Q) having a frame end and a common end, the frame end being pivotably connected to the frame at a joint (QF);

a link (R) having a rail end and a common end, the rail end being pivotably connected to the rail at a joint (RR), the common ends of the link (Q) and the link (R) being pivotably connected to each other at a joint (A) by an element that extends parallel to the first pivot axis, the element being constrained to move substantially parallel to the reaction surface while engaging and moving along the reaction surface as the links (P), (Q), and (R) pivot during movement of the rail between deployed and stowed positions, the links (Q) and (R) folding about joint (A) during movement of the rail toward the stowed position and unfolding about joint (A) during movement of the rail toward the deployed position.

2. The siderail assembly of claim 1 comprising two substantially parallel reaction surfaces, the joint (A) being constrained to move substantially parallel to the reaction surfaces.

3. The siderail assembly of claim 2 wherein the reaction surfaces cooperate with each other to define a slot, the joint (A) being constrained to move substantially parallel to the slot.

4. The siderail assembly of claim 2 wherein the rail is moveable relative to the frame through a range of motion and wherein the reaction surfaces have an orientation that resists a tendency of the rail to rock laterally.

5. The siderail assembly of claim 1 wherein the rail is moveable relative to the frame through a range of motion and wherein the reaction surface has an orientation that resists a tendency of the rail to rock laterally.

6. The siderail assembly of claim 1 wherein the rail is moveable relative to the frame through a range of motion, the relative orientation of the reaction surface and a line through joints (RR) and (A) being sufficiently nonparallel to each other to constrain relative movement of joints (RR) and (PR).

7. The siderail assembly of claim 6 wherein the line and the reaction surface are more perpendicular than parallel.

8. The siderail assembly of claim 1 wherein the rail is moveable relative to the frame through a range of motion between the deployed position and the stowed position and the joints are spatially distributed such that the rail assumes a prescribed orientation at least at the deployed and stowed positions.

9. The siderail assembly of claim 8 wherein the prescribed orientation of the deployed rail is a substantially upright orientation and the prescribed orientation of the stowed rail is a laterally outwardly leaning orientation.

10. The siderail assembly of claim 1 wherein the bed frame includes a substantially flat deck having a lateral extremity, joints (QF) and (PF) being at an elevation lower than the deck and laterally inboard of the lateral extremity.

11. The siderail assembly of claim 1 comprising longitudinally spaced apart link portions ($Q_H$) and ($Q_F$), longitudinally spaced apart link portions ($R_H$) and ($R_F$), and wherein link (P) is longitudinally intermediate link portions ($Q_H$), ($R_H$) and link portions ($Q_F$), ($R_F$).

12. The siderail assembly of claim 1 wherein link (P) comprises longitudinally spaced apart link portions ($P_H$) and ($P_F$), and wherein links (Q) and (R) are longitudinally intermediate link portions ($P_H$) and ($P_F$).

13. The siderail assembly of claim 12 wherein link (Q) comprises longitudinally spaced apart link portions ($Q_H$) and ($Q_F$), and link (R) comprises longitudinally spaced apart link portions ($R_H$) and ($R_F$).

14. The siderail assembly of claim 1 wherein the rail is moveable through a range of motion that includes the deployed position and the rail is latchable only at the deployed position.

15. The siderail assembly of claim 1, the rail being mountable on a bed that includes a deck for supporting a mattress having a top surface, the deck having a top and a bottom and being elevation adjustable between a maximum elevation and a minimum elevation, the rail having a top and a bottom and being moveable through a range of motion that includes the deployed position and the stowed position, and wherein:

in the deployed position the top of the rail is at least about 9 inches higher than the top surface of the mattress and the bottom of the rail is no more than about 2 inches higher than the top of the deck; and in the stowed position, and with the deck at its minimum elevation, the bottom of the rail is at least about 3 inches above the floor.

16. The siderail assembly of claim 15 wherein the minimum elevation is measured between the floor and the lowest point on the bottom of the deck.

17. A siderail assembly for a bed comprising:

a link (P) pivotably connectable to a bed frame at a joint (PF) and to a rail at a joint (PR), the link (P) having at least one reaction surface;

a link (Q) having a frame end and a common end, the frame end being pivotably connected to the frame at a joint (QF); and a link (R) having a rail end and a common end, the rail end being pivotably connected to the rail at a joint (RR), the common ends of the link (Q) and the link (R) being pivotably connected to each other at a joint (A) constrained to move substantially parallel to the reaction surface, and wherein link (Q) comprises longitudinally spaced apart link portions ($Q_H$) and ($Q_F$), wherein link (R) comprises longitudinally spaced apart link portions ($R_H$) and ($R_F$), and wherein link (P) is longitudinally intermediate link portions ($Q_H$), ($R_H$) and link portions ($Q_F$), ($R_F$).

18. A siderail assembly for a bed comprising:

a link (P) pivotably connectable to a bed frame at a joint (PF) and to a rail at a joint (PR), the link (P) having at least one reaction surface;

a link (Q) having a frame end and a common end, the frame end being pivotably connected to the frame at a joint (QF); and a link (R) having a rail end and a common end, the rail end being pivotably connected to the rail at a joint (RR), the common ends of the link (Q) and the link (R) being pivotably connected to each other at a joint (A) constrained to move substantially parallel to the reaction surface, wherein link (P) comprises longitudinally spaced apart link portions ($P_H$) and ($P_F$), and wherein links (Q) and (R) are longitudinally intermediate link portions ($P_H$) and ($P_F$).

19. The siderail assembly of claim 18 wherein link (Q) comprises longitudinally spaced apart link portions ($Q_H$) and ($Q_F$), and link (R) comprises longitudinally spaced apart link portions ($R_H$) and ($R_F$).

* * * * *